US009644433B2

(12) United States Patent
Mueller et al.

(10) Patent No.: US 9,644,433 B2
(45) Date of Patent: May 9, 2017

(54) ELECTRONIC FRAME HAVING CONDUCTIVE AND BYPASS PATHS FOR ELECTRICAL INPUTS FOR USE WITH COUPLED CONDUIT SEGMENTS

(71) Applicants: Stephan Mueller, Hannover (DE); Ingo Roders, Seelze (DE); Robert Buda, Lower Saxony (DE); Henning Rahn, Celle (DE); Volker Peters, Wienhausen (DE); Hans Oppelaar, Bergen (DE); Rene Schulz, Hambühren (DE); Detlev Benedict, Celle (DE)

(72) Inventors: Stephan Mueller, Hannover (DE); Ingo Roders, Seelze (DE); Robert Buda, Lower Saxony (DE); Henning Rahn, Celle (DE); Volker Peters, Wienhausen (DE); Hans Oppelaar, Bergen (DE); Rene Schulz, Hambühren (DE); Detlev Benedict, Celle (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 925 days.

(21) Appl. No.: 14/012,391

(22) Filed: Aug. 28, 2013

(65) Prior Publication Data

US 2015/0060041 A1 Mar. 5, 2015

(51) Int. Cl.
*E21B 17/02* (2006.01)
*E21B 47/01* (2012.01)

(52) U.S. Cl.
CPC ..... *E21B 17/028* (2013.01); *E21B 47/01* (2013.01); *Y10T 307/76* (2015.04)

(58) Field of Classification Search
CPC ..... E21B 17/023; E21B 17/028; Y10T 307/76
USPC ..... 307/115
See application file for complete search history.

(56) References Cited

U.S. PATENT DOCUMENTS 6,392,317 B1 5/2002 Hall et al.
6,727,827 B1 4/2004 Edwards et al.
6,816,082 B1 * 11/2004 Laborde ..... E21B 47/12 340/853.2
7,098,802 B2 8/2006 Hall et al.
7,139,218 B2 11/2006 Hall et al.
7,207,396 B2 4/2007 Hall et al.
(Continued)

FOREIGN PATENT DOCUMENTS

WO 2012116984 A2 9/2012

OTHER PUBLICATIONS

Notification of Transmittal of the International Search Report and the Written Opinion of the International Searching Authority, or the Declaration; PCT/US2013/074979, Mailed Mar. 26, 2014, 11 pages.
(Continued)

*Primary Examiner* — Fritz M Fleming
(74) *Attorney, Agent, or Firm* — Cantor Colburn LLP

(57) ABSTRACT

An electronic frame for use in a downhole component coupling mechanism in a segmented wired pipe system includes a first frame element including at least one retaining structure configured to retain an electronic component. The frame also includes a sealed chamber disposed in the frame element, the sealed chamber including inputs to receive input signals from communication elements and either couple the inputs together or direct the input signals to control electronics.

14 Claims, 8 Drawing Sheets

(56) References Cited

U.S. PATENT DOCUMENTS

| | | | | |
|---|---|---|---|---|
| 7,224,288 | B2 | 5/2007 | Hall et al. | |
| 7,253,745 | B2 | 8/2007 | Hall et al. | |
| 7,667,942 | B2 * | 2/2010 | Boling | H02J 7/0031 361/103 |
| 8,091,627 | B2 | 1/2012 | Hall et al. | |
| 8,242,928 | B2 | 8/2012 | Prammer | |
| 8,952,574 | B2 * | 2/2015 | Bonavides | H02J 4/00 307/113 |
| 9,431,813 | B2 * | 8/2016 | Menezes | E21B 17/028 |
| 2002/0193004 | A1 | 12/2002 | Boyle et al. | |
| 2003/0213595 | A1 * | 11/2003 | Jackson | E21B 41/0021 166/297 |
| 2006/0013065 | A1 * | 1/2006 | Varsamis | G01V 11/002 367/76 |
| 2007/0023185 | A1 | 2/2007 | Hall et al. | |
| 2008/0230232 | A1 | 9/2008 | Farrara et al. | |
| 2009/0014175 | A1 | 1/2009 | Peter | |
| 2009/0058675 | A1 | 3/2009 | Sugiura | |
| 2009/0151926 | A1 | 6/2009 | Hall et al. | |
| 2009/0289808 | A1 | 11/2009 | Prammer | |
| 2010/0097890 | A1 | 4/2010 | Sullivan et al. | |
| 2010/0300677 | A1 | 12/2010 | Patterson et al. | |
| 2012/0111555 | A1 | 5/2012 | Leveau et al. | |
| 2012/0125686 | A1 | 5/2012 | Hogseth et al. | |
| 2014/0176334 | A1 * | 6/2014 | Benedict | G01V 3/34 340/854.4 |
| 2014/0332235 | A1 | 11/2014 | Mueller et al. | |

OTHER PUBLICATIONS

Notification of Transmittal of the International Search Report and the Written Opinion of the International Searching Authority, or the Declaration; PCT/US2014/0035619; Mailing date: Aug. 21, 2014, 9 pages.

Wassermann, et al. "How High-Speed Telemetry Affects the Drilling Process", Technology Update, JPT, Jun. 2009. 4 pages.

* cited by examiner

ELECTRONIC FRAME HAVING CONDUCTIVE AND BYPASS PATHS FOR ELECTRICAL INPUTS FOR USE WITH COUPLED CONDUIT SEGMENTS

BACKGROUND

During subterranean drilling and completion operations, various power and/or communication signals may be transmitted through pipe segments or other downhole components, e.g., via a "wired pipe" configuration. Such configurations include electrical, optical or other conductors extending along the length of selected pipe segments. The conductors are operably connected between pipe segments by a variety of coupling configurations.

One such coupling configuration includes a threaded male-female configuration often referred to as a pin box connection. The pin box connection includes a male member, i.e., a "pin end" that includes an exterior threaded portion, and a female member, i.e., a "box end", that includes an interior threaded portion and is configured to receive the pin in a threaded connection.

Signal repeaters have been used to enhance transmission of power and communications between components over a telemetry line or system. Such repeaters are provided to reduce signal loss during transmission of data from downhole components to the surface.

SUMMARY

According to one embodiment, an electronic frame for use in a downhole component coupling mechanism in a segmented wired pipe system is disclosed. The electronic frame of this embodiment includes a first frame element including at least one retaining structure configured to retain an electronic component and a sealed chamber disposed in the frame element. The sealed chamber includes inputs to receive input signals from communication elements and either couple the inputs together or direct the input signals to control electronics.

According to another embodiment, a sealed chamber for disposal in a frame for use in a downhole component coupling mechanism includes inputs to receive an input signals from communication elements and either couple the inputs together or direct the input signals to control electronics, the inputs being at least partially sealed within the sealed chamber.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed system, apparatus and method are presented herein by way of exemplification and not limitation with reference to the Figures.

Figure 1:
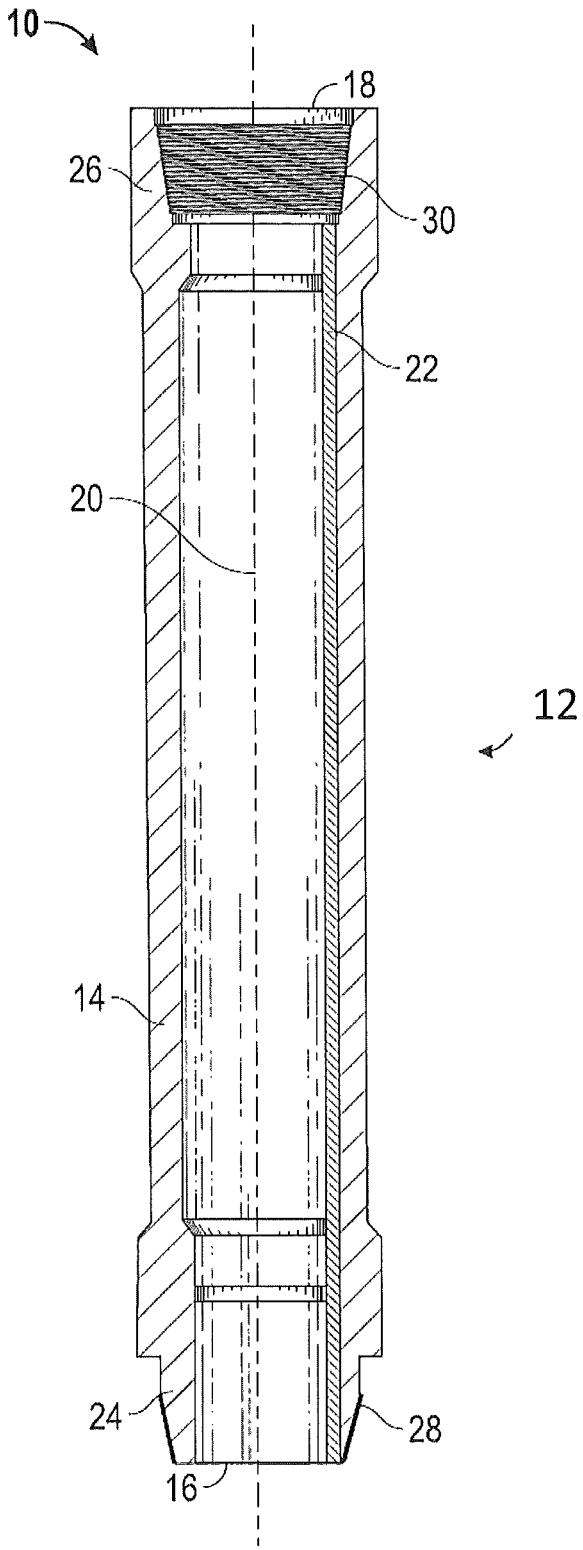
FIG. 1 depicts an embodiment of a conduit segment of a downhole system.

Referring to FIG. 1, an exemplary embodiment of a portion of a well drilling, logging and/or production system 10 includes a conduit or string 12, such as a drillstring or production string, that is configured to be disposed in a borehole for performing operations such as drilling the borehole, making measurements of properties of the borehole and/or the surrounding formation downhole, or facilitating gas or liquid production.

For example, during drilling operations, drilling fluid or drilling "mud" is introduced into the string 12 from a source such as a mud tank or "pit" and is circulated under pressure through the string 12, for example via one or more mud pumps. The drilling fluid passes into the string 12 and is discharged at the bottom of the borehole through an opening in a drill bit located at the downhole end of the string 12. The drilling fluid circulates uphole between the string 12 and the borehole wall and is discharged into the mud tank or other location.

The string 12 may include at least one wired pipe segment 14 having an uphole end 18 and a downhole end 16. As described herein, "uphole" refers to a location near the point where the drilling started relative to a reference location when the segment 14 is disposed in a borehole, and "downhole" refers to a location away from the point where the drilling started along the borehole relative to the reference location. It shall be understood that the uphole end 18 could be below the downhole end 16 without departing from the scope of the disclosure herein.

At least an inner bore or other conduit 20 extends along the length of each segment 14 to allow drilling mud or other fluids to flow therethrough. A transmission line 22 is located within the wired segment 14 to provide protection for electrical, optical or other conductors to be disposed along the wired segment 14. In one embodiment, the transmission line 22 is a coaxial cable. In another embodiment, the transmission line 22 is formed of any manner of carrying power or data, including, for example, a twisted pair. In the case where the transmission line 22 is a coaxial cable it may include an inner conductor surrounded by a dielectric material. The coaxial cable may also include a shield layer that surrounds the dielectric. In one embodiment, the shield layer is electrically coupled to an outer conductor that may be formed, for example, by a rigid or semi-rigid tube of a conductive material.

The segment 14 includes a downhole connection 24 and an uphole connection 26. The segment 14 is configured so that the uphole connection 26 is positioned at an uphole location relative to the downhole connection 24. The downhole connection 24 includes a male coupling portion 28 having an exterior threaded section, and is referred to herein as a "pin end" 24. The uphole connection 26 includes a female coupling portion 30 having an interior threaded section, and is referred to herein as a "box end" 26.

The pin end 24 and the box end 26 are configured so that the pin end 24 of one wired pipe segment 14 can be disposed within the box end 26 of another wired pipe segment 14 to effect a fixed connection there between to connect the segment 14 with another adjacent segment 14 or other downhole component. In one embodiment, the exterior of the male coupling portion 28 and the interior of the female coupling portion 30 are tapered. Although the pin end 24 and the box end 26 are described as having threaded portions, the pin end 24 and the box end 26 may be configured to be coupled using any suitable mechanism, such as bolts or screws or an interference fit.

As described herein, "drillstring" or "string" refers to any structure or carrier suitable for lowering a tool through a borehole or connecting a drill bit to the surface, and is not limited to the structure and configuration described herein. For example, a string could be configured as a drillstring, hydrocarbon production string or formation evaluation string. The term "carrier" as used herein means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof. Other carrier examples include casing pipes, wirelines, wireline sondes, slickline sondes, drop shots, downhole subs, BHA's and drill strings.

Figure 2:
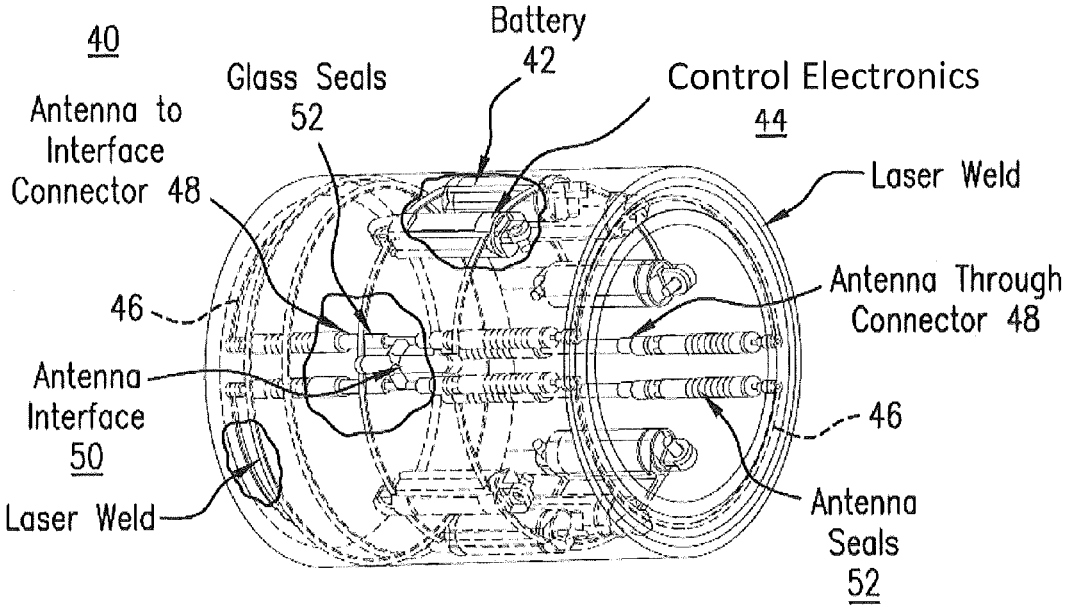
FIG. 2 depicts an embodiment of an electronic frame housing various electronic components.

FIG. 2 illustrates an embodiment of a pressure-sealed and mechanically robust electronic frame 40 configured to be disposed within a coupling assembly between downhole components, e.g., within a space formed within the pin end 24 and/or the box end 26. In one embodiment, the electronic frame 40 includes electronics configured to facilitate wired pipe telemetry or other communications. In one embodiment, the frame 40 is mechanically distinct and separate from the coupling portions and the downhole components, and is configured to be secured by the coupling assembly and/or the downhole components. Thus, the frame 10 does not need to be directly sealed or adhered to the connection components, but rather can rely upon the already existing sealing engagement between the components (e.g., the box-pin connection).

As shown in FIG. 2, the frame 40 is configured to support electronics for drill pipes, downhole tools and other downhole components. Exemplary electronics include repeater electronics of a signal transmission system configured to transmit power and/or communications between downhole components. For example, the frame 40 includes recesses, chambers or other retaining structures to house repeater components (e.g., electronics and sealing components) for transmitting signals between components. Such exemplary repeater components include batteries 42, control electronics 44 such as multi-chip modules (MCMs), and signal coupling elements 46 such as coupler rings, antennas, electrical contacts and inductive coupling elements. The coupling elements may be of any suitable type, such as inductive coils, direct (galvanic) electrical contacts, antennas and an optical connection ring. Other exemplary components include transmission components such as connectors 48, interfaces 50 and various sealing components 52 such as glass seals and antenna seals.

FIG. 3 illustrates an embodiment of the electronic frame 40 in various stages of assembly with the coupling assembly. As demonstrated in FIG. 3, in some embodiments, the frame 40 is separate and removable from the coupling mechanism and is shaped or otherwise configured to sit within a portion of the coupling mechanism and held axially in place by the coupling mechanism without requiring any additional connection or securing features. FIG. 3A shows the frame 40 prior to assembly. FIG. 3B shows the frame 40 disposed or mounted within an elongated box bore-back 54. The bore-back 54 typically includes a reduction of internal diameter behind the threaded portion of the box 26, and generally provided to reduce stress concentrations during static and dynamic loading.

Figure 3A:
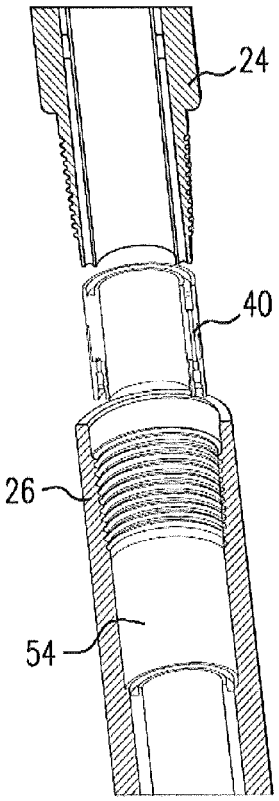
FIGS. 3A-3D (collectively referred to as FIG. 3) depict an exemplary electronic frame disposed in a coupling assembly of a first and second downhole component.
Figure 3B:
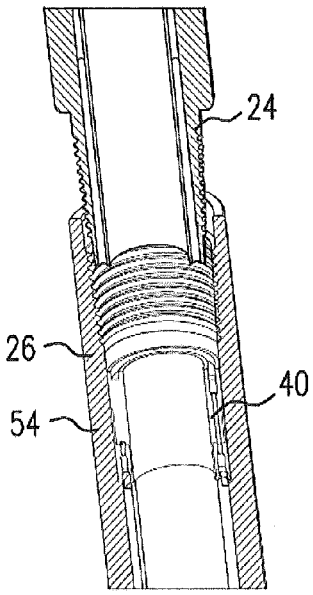
Figure 3C:
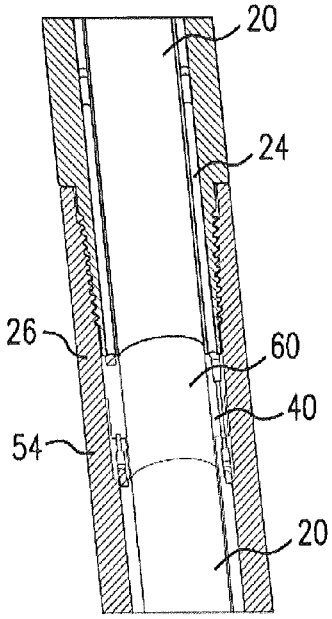
Figure 3D:
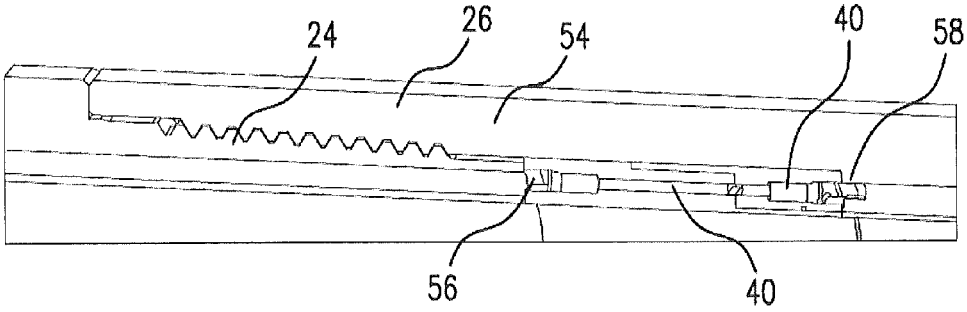

The frame 40 is not adhered to or rotationally fixed within the bore-back 54, although the frame 40 can be adhered or fixed if desired. FIGS. 3C and 3D show the frame 40 within a fully assembled coupling between downhole components (e.g., pipe segments 14). The frame 40 (or at least the outer diameter or surface of the frame 40) is entirely encapsulated within the string 12 and is held axially in place by, e.g., the pin face 56 and a shoulder 58 formed by the transition between the bore-back 54 and the main inner bore 20 of the string segment 14. The frame 40 is thus axially secured solely due to the threaded connection and is encapsulated within the connection and tools.

The frame 40, which in this embodiment is of a generally cylindrical shape (although embodiments are not limited to a particular shape) defines a fluid conduit 60, which may be in the form of an inner or central bore, that provides fluid connection between the bores 20 of the string segments 14. The fluid conduit 60, in one embodiment, is a cylindrical central conduit having a diameter that is at least substantially equal to the diameter of the bores 20, although the conduit 60 can have a smaller diameter or have any shape or diameter suitable to transmit fluid between the segments 14. The frame also includes an outer surface (e.g., a cylindrical surface) that is configured to fit within the bore-back 54.

As will be appreciated, the frame disclosed herein is subject to harsh downhole conditions. In some cases, there may exist occasions where the control electronics 44 or other electronics contained in the frame 40 may become damaged. In one embodiment, a failsafe-chamber (sealed chamber herein) is included in the frame that may disconnect the control electronics 44 from the communication path between signal coupling elements 46 disposed at opposite ends of the frame 40. Stated differently, the sealed chamber may either direct input signals received from inputs (e.g., from antennas disposed in the frame) to the control electronics or couple the elements together and bypass the control element electronics. One possible reason why the electronics 44 may fail is that water or mud has entered into the frame 40.

The sealed chamber disclosed herein may be located in the frame 40 and may be implemented as a pressure sealed chamber which contains electronics to disconnect the damaged electronics and shortcut the communication path. It could also be possible to integrate a full backup of the repeater electronics in the chamber.

Figure 4A:
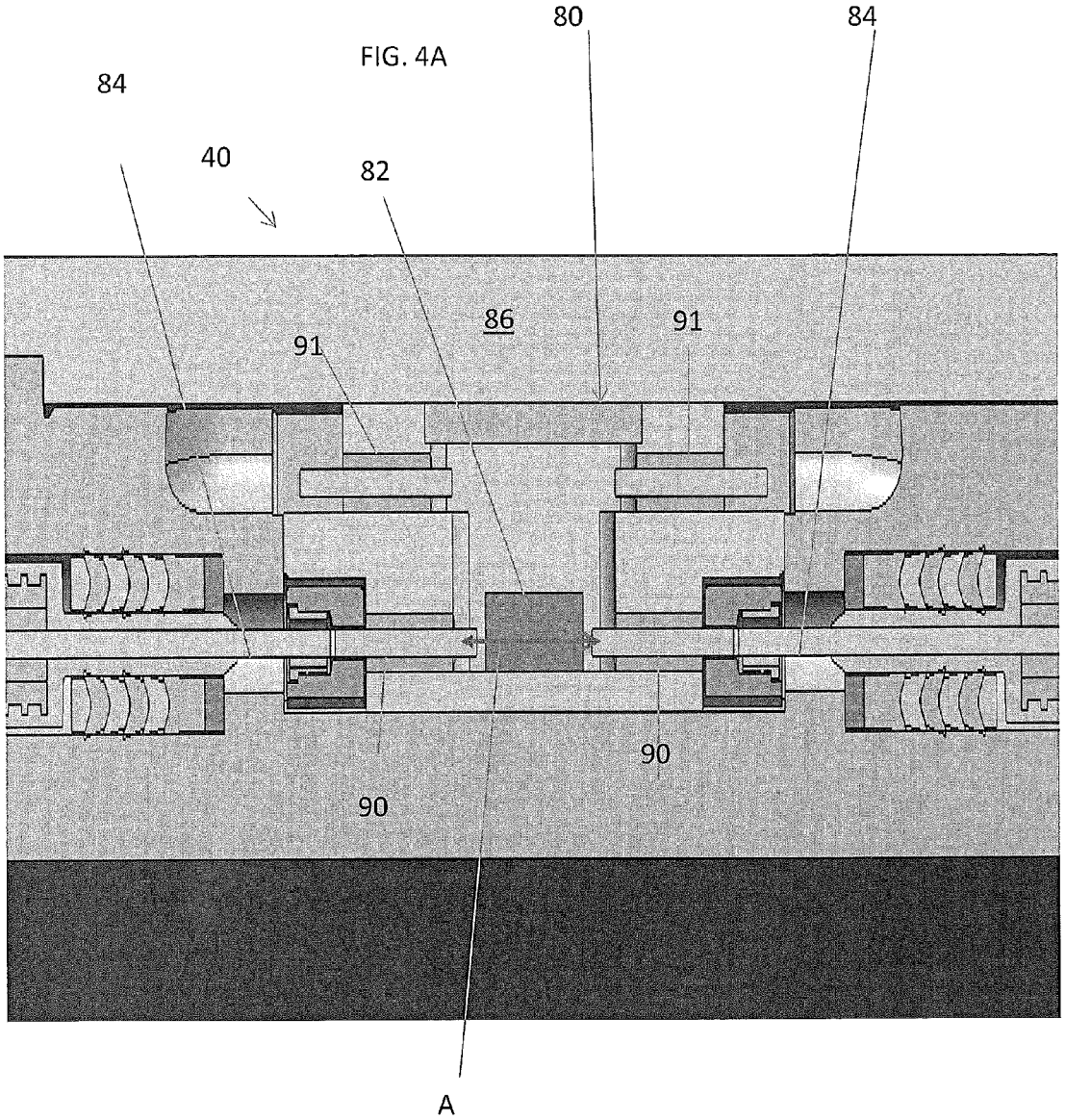
FIGS. 4A-4B (collectively referred to as FIG. 4) depict embodiments of an sealed chamber that may be utilized in an electronics frame for electronically coupling downhole components.
Figure 4B:
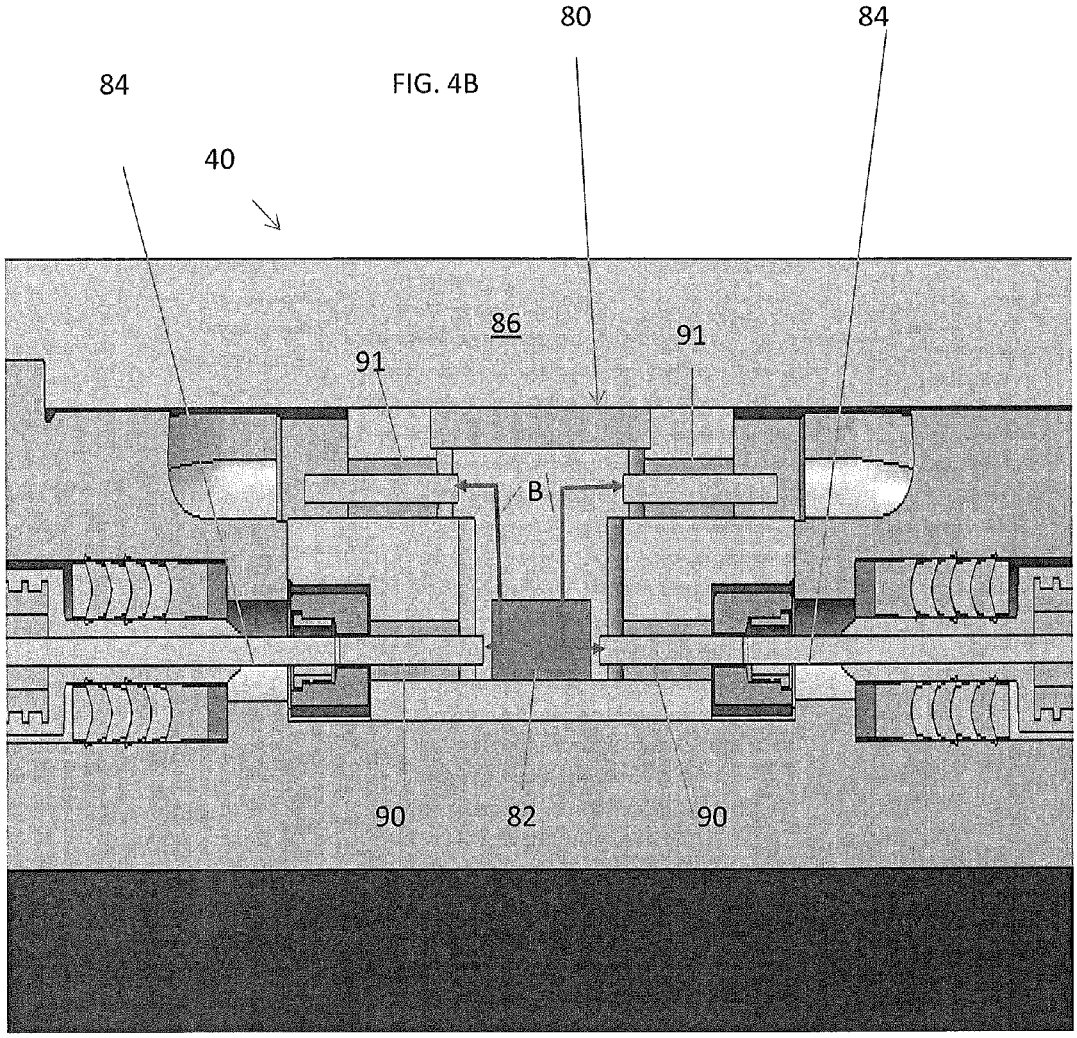

FIGS. 4A and 4B show a partial cut-away side view of a frame 40 carrying a sealed chamber 80 that includes an internal bypass controller 82. The sealed chamber 80 may be encased in an outer portion 86 of the frame 40 in one embodiment. The bypass controller 82 is in electrical communication with connectors 84 (e.g., inputs) that are both in electrical communication with communication elements 46 (not shown) disposed at either end of the frame 40 in, for example, a manner as shown in FIG. 2. The bypass controller 82 causes an electrical signal to be communicated directly between the connectors 84 as indicated by path A (FIG. 4A) or to travel through leads 91 connected to control electronics (not shown) as indicated by paths B.

The sealed chamber 80 includes seals 90 around elements that enter or leave it to form paths A or B (e.g., seals may be provided around connectors 84 and/or leads 91). Such seals may be provided by preferable a glass seal, but elastomeric seal components or PEEK seals may also be used. In one embodiment, any conductor forming paths A or B and inside could be coated for isolation.

Figure 7:
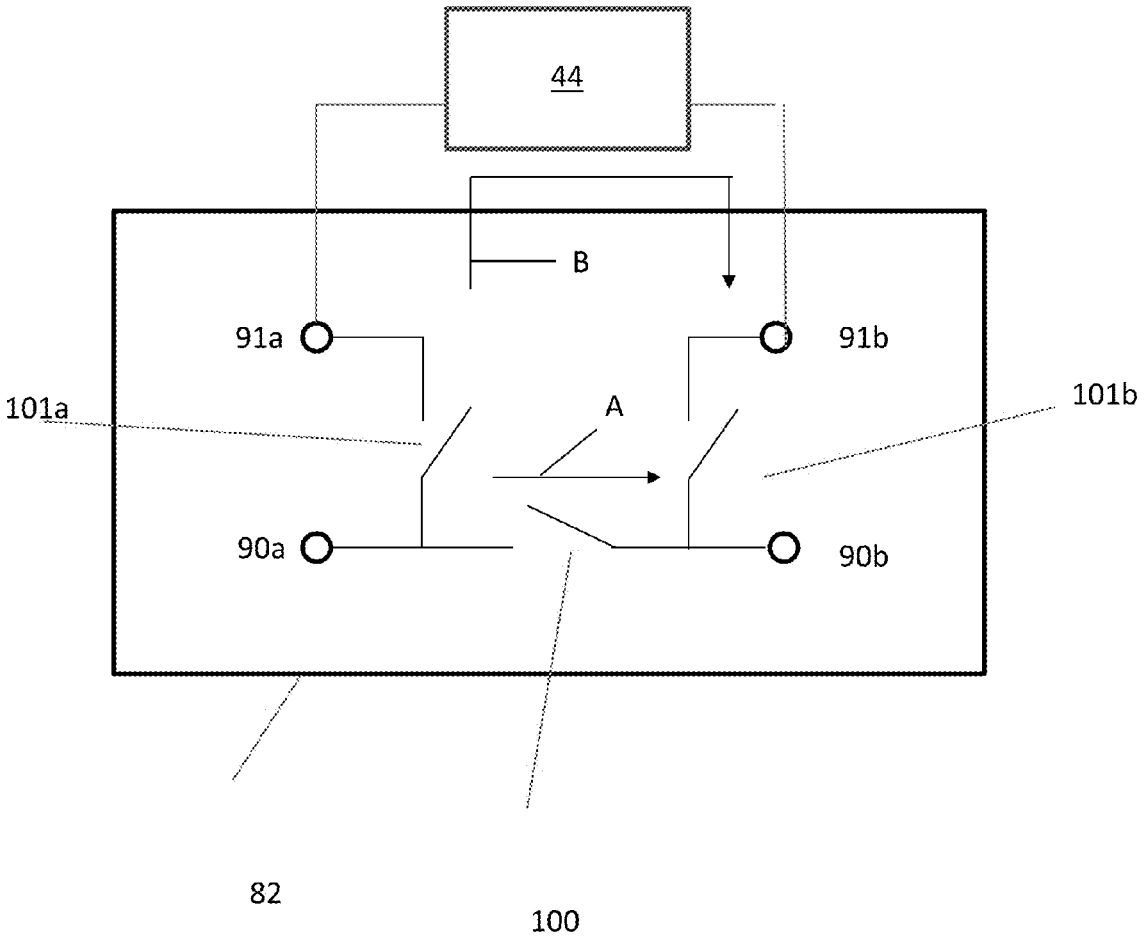
FIG. 7 depicts an example of bypass electronics according to one embodiment.

The bypass controller 82 may include sensors or other means to determine which path (A or B) to direct signals over. The electronics could be as simple as one or two switches that switch from path B (the default state) to path A (the bypass state) in the event that no signal is sensed over path B. In another embodiment, the bypass controller 82 transitions from the default state (path B) to the bypass state (path A) in the event that no signal is being received from the control electronics. For instance, and with reference to FIG. 7, the bypass controller 84 may include inputs shown as connectors 84*a* and 84*b* and leads 91*a* and 91*b* that connect to control electronics 44. In the default state switches 101*a* and 101*b* are conducting and current flows over path B. In the bypass state, switch 100 is closed and one or both of switches 101*a* and 101*b* may be nonconductive and current flows over path A.

Figure 5A:
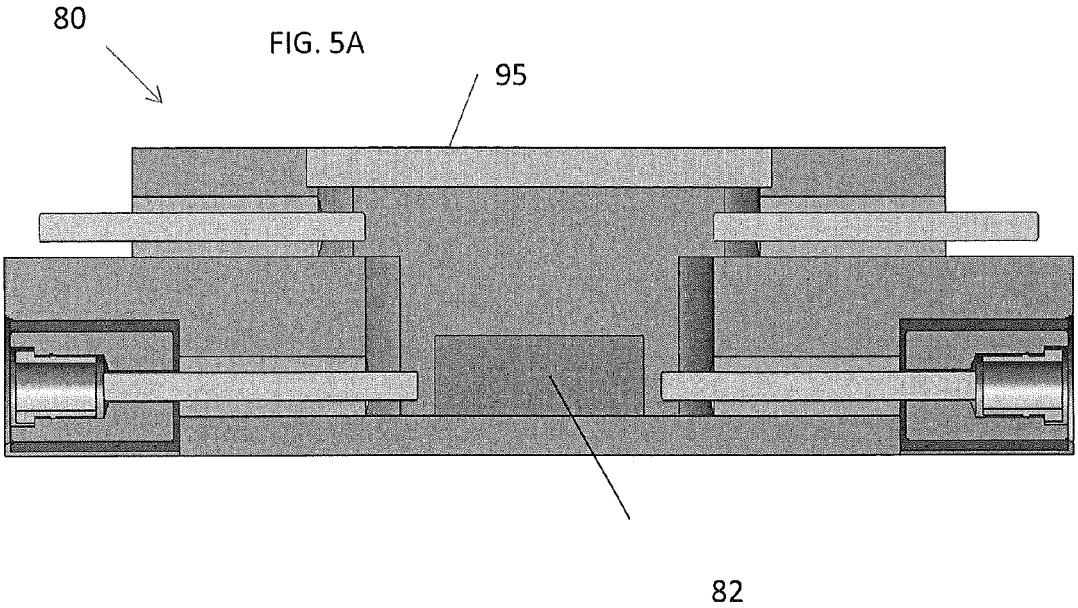
FIGS. 5A-5B (collectively referred to as FIG. 5) depict an embodiment of a sealed chamber.
Figure 5B:
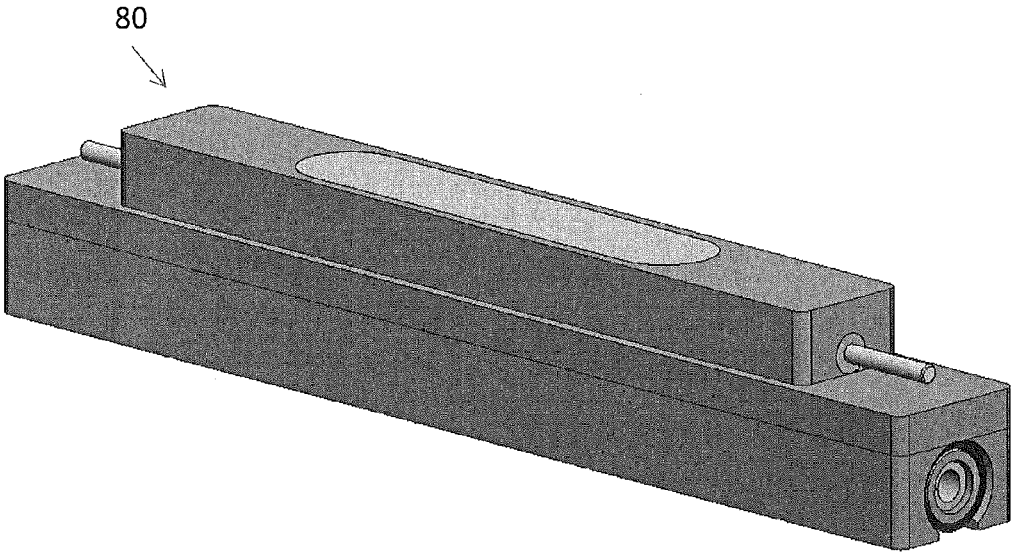

FIGS. 5A and 5B, respectively, illustrate a cut-away side view and perspective view of the chamber 80 shown in FIGS. 4A and 4B. In one embodiment, the chamber 80 is made of high strength material and has a cover plate 95 which is welded onto or into the chamber 80 to hermetically seal it after installing the electronics inside.

Figure 6:
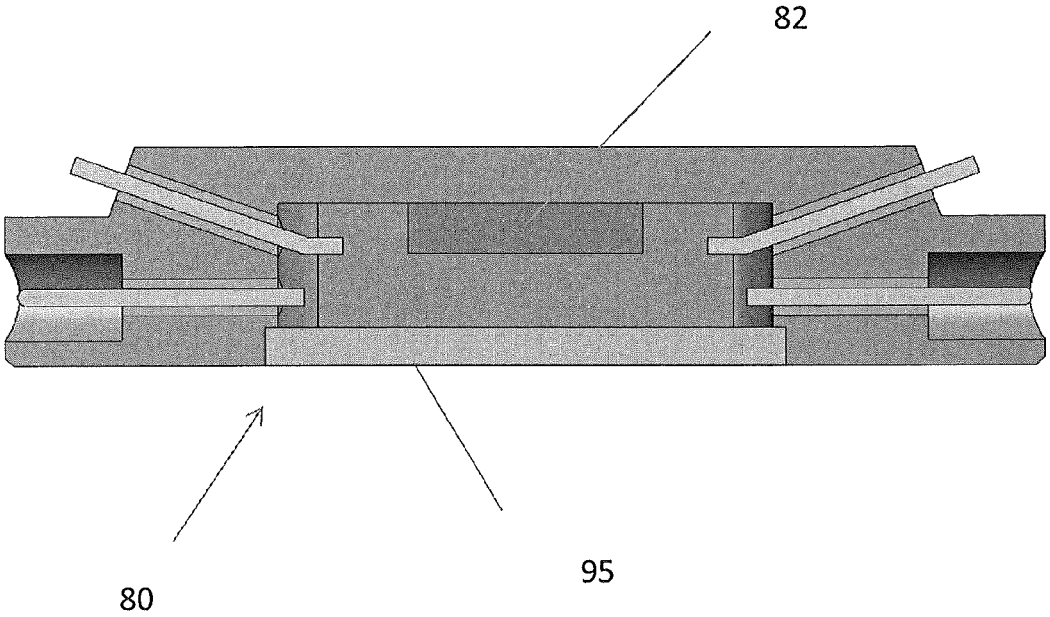
FIG. 6 depicts another embodiment of a sealed chamber.

It shall be understood that the chamber 80 can be configured in any manner. For instance, an alternative configuration is shown in FIG. 6.

The electronic frame that includes a sealed chamber 80 described herein can provide reliable active and/or passive signal transmission between drill string components respectively between, e.g., mounted coupler rings (with or without galvanic contact). The frame, as shown in some embodiments, can also provide redundancy with respect to electrical failure as well as mechanical failure.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the appended claims.

What is claimed is:

1. An electronic frame for use in a downhole component coupling mechanism in a segmented wired pipe system, comprising:

a first frame element including at least one retaining structure configured to retain an electronic component; and a sealed chamber disposed in the frame element, the sealed chamber including inputs to receive input signals from communication elements and either couple the inputs together or direct the input signals to control electronics.

2. The frame of claim 1, wherein the sealed chamber includes a bypass controller that controls whether the inputs are coupled together or the input signals are directed to control electronics.

3. The frame of claim 1, wherein the bypass controller includes a default state and a bypass state.

4. The frame of claim 3 wherein in the default state the input signals are directed to control electronics and in the bypass state inputs are coupled together.

5. The electronic frame of claim 4, further comprising:

additional control electronics disposed within the sealed chamber.

6. The frame of claim 1, wherein the bypass controller transitions from the default state to the bypass state in the event that no signal is being received from the control electronics when expected.

7. The electronic frame of claim 1, further comprising a fluid conduit formed by the frame element configured to provide fluid communication through the coupling mechanism.

8. The electronic frame of claim 1, wherein the coupling mechanism includes a pin end located at an end of a first downhole component and a box end at an end of a second downhole component.

9. The electronic frame of claim 8, wherein the electronic frame is configured to be disposed in a bore-back region of the box end and constrained axially by the pin end and the box end when the coupling mechanism is assembled.

10. A sealed chamber for disposal in a frame for use in a downhole component coupling mechanism, comprising:

inputs to receive an input signals from communication elements and either couple the inputs together or direct the input signals to control electronics, the inputs being at least partially sealed within the sealed chamber.

11. The sealed chamber of claim 10, wherein the sealed chamber includes a bypass controller that controls whether the inputs are coupled together or the input signals are directed to control electronics disposed in a frame disposed in the downhole component coupling mechanism.

12. The sealed chamber of claim 10, wherein the bypass controller includes a default state and a bypass state.

13. The sealed chamber of claim 10, wherein in the default state the input signals are directed to control electronics and in the bypass state inputs are coupled together.

14. The sealed chamber of claim 10, wherein the bypass controller transitions from the default state to the bypass state in the event that no signal is being received from the control electronics when expected.

* * * * *